United States Patent [19]

Hanson et al.

[11] 4,072,477

[45] Feb. 7, 1978

[54] ELECTROSTATIC PRECIPITATION PROCESS

[75] Inventors: Donald N. Hanson, Orinda; Charles R. Wilke, El Cerrito, both of Calif.

[73] Assignee: The Regents of the University of California, Berkeley, Calif.

[21] Appl. No.: 560,980

[22] Filed: Mar. 21, 1975

Related U.S. Application Data

[63] Continuation of Ser. No. 252,406, May 11, 1972, abandoned, which is a continuation-in-part of Ser. No. 700,436, Jan. 25, 1968, abandoned, which is a continuation-in-part of Ser. No. 518,405, Jan. 3, 1966, abandoned.

[51] Int. Cl.[2] ..... B03C 3/01

[52] U.S. Cl. ..... 55/10; 55/5; 55/107; 55/122; 55/134; 55/136; 55/138; 55/DIG. 38

[58] Field of Search ..... 55/134, 136, 4, 5, 6, 55/10, 11, 101, 107, 118, 120, 122, 138, DIG. 38; 310/4, 5, 6, 10, 11; 204/180

[56] References Cited

U.S. PATENT DOCUMENTS

| | | | |
|---|---|---|---|
| 2,758,666 | 8/1956 | Prentiss | 55/107 X |
| 3,129,157 | 4/1964 | Loeckenhoff | 204/180 |
| 3,191,077 | 6/1965 | Marks et al. | 310/5 |
| 3,411,025 | 11/1968 | Marks | 310/11 |
| 3,449,667 | 6/1969 | Gourdine | 340/237 R X |
| 3,452,225 | 6/1969 | Gourdine | 310/11 |
| 3,519,855 | 7/1970 | Gourdine | 310/10 |
| 3,551,710 | 12/1970 | Gourdine | 310/6 X |
| 3,558,286 | 1/1971 | Gourdine | 23/288 |
| 3,582,694 | 6/1971 | Gourdine | 55/138 X |
| 3,585,060 | 6/1971 | Gourdine et al. | 117/17 |
| 3,592,541 | 7/1971 | Gourdine | 96/1 R X |
| 3,613,993 | 10/1971 | Gourdine et al. | 239/3 |
| 3,673,463 | 6/1972 | Gourdine | 317/3 |

OTHER PUBLICATIONS

Foster, W. W., "Deposition of Unipolar Charged Aerosol Particles by Mutual Repulsion," British Journal of Applied Physics, vol. 10, No. 5, May, 1959, pp. 206–213.

Kahn et al., "Electrogasdynamic Power Generation," American Institute of Aeronautics and Astronautics (AIAA Journal), vol. 2, No. 8, Aug., 1964, pp. 1423–1427.

*Primary Examiner*—Frank W. Lutter
*Assistant Examiner*—Kathleen J. Prunner
*Attorney, Agent, or Firm*—Flehr, Hohbach, Test, Albritton & Herbert

[57] ABSTRACT

An electrostatic precipitator which operates on the principle of mutual repulsion of charged particles to a grounded wall. The solid particle laden gas stream enters a collecting section where additional particles in the form of droplets, normally water, are injected in the form of a fine spray into the solid particle laden gas stream. The solid particles and the additional particles are electrostatically charged either by conventional corona or by injecting the droplets from a charged nozzle and as the charged particles pass through the grounded section of the precipitator, a fraction of the water particles and solids are forced to the grounded wall by electric fields created by the space charge. Precipitated solid particles are entrained in the coalesced water which runs down the walls and is drained from the precipitator. Several stages of precipitation may be used or alternatively, methods such as continuously injecting additional particles into the collector along its length.

2 Claims, 13 Drawing Figures

FIG_1
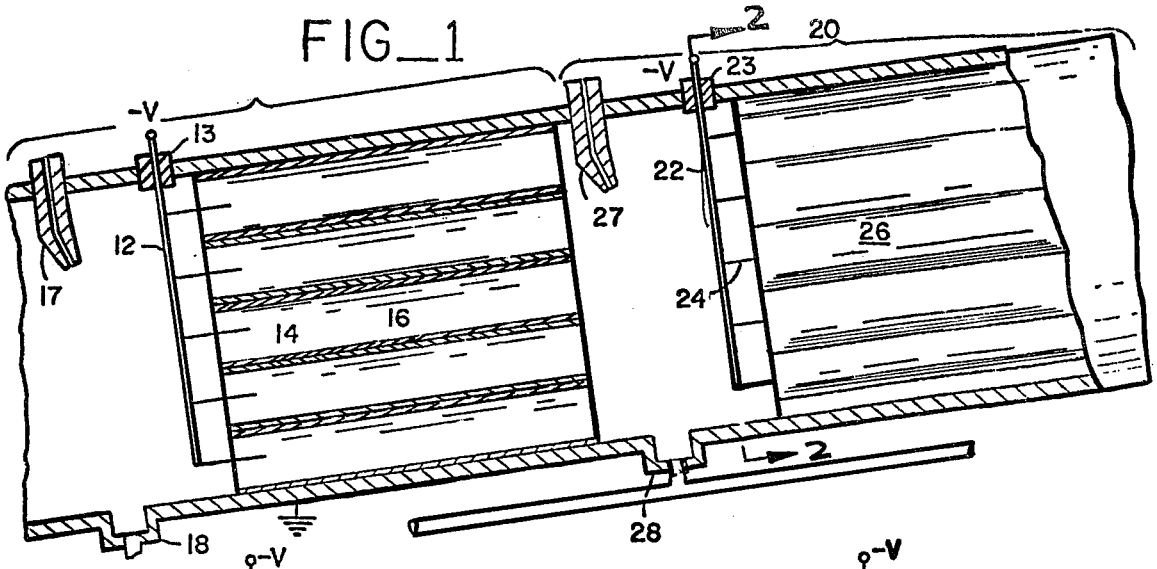
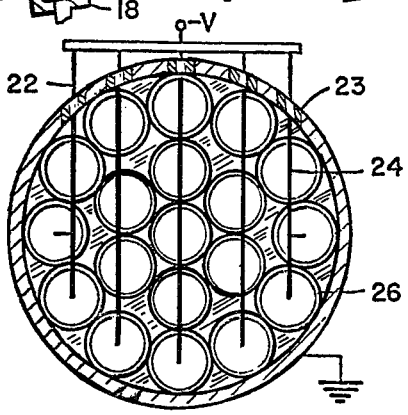
FIG_2
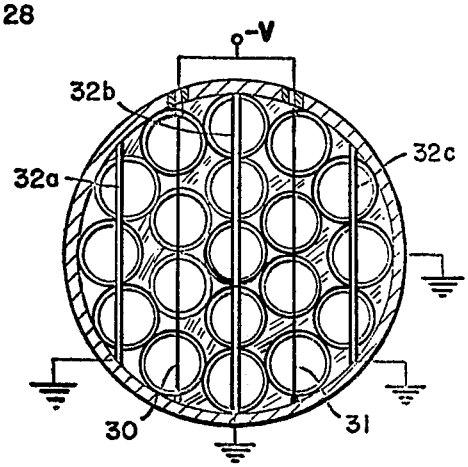
FIG_7
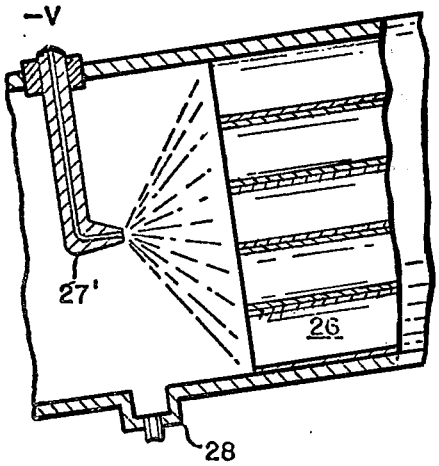
FIG_8
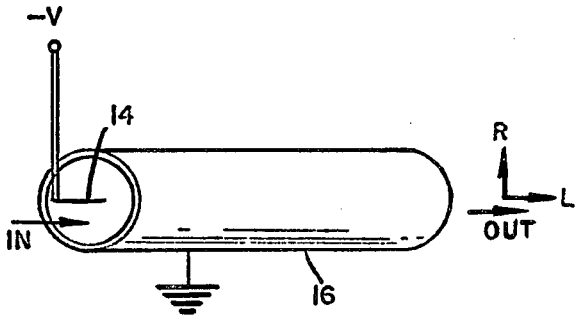
FIG_3

ELECTROSTATIC PRECIPITATION PROCESS

CROSS-REFERENCE TO RELATED APPLICATION

This application is a continuation of now abandoned application Ser. No. 252,406 filed May 11, 1972 which is a continuation-in-part of now abandoned application Ser. No. 700,436 filed Jan. 25, 1968, in the names of Donald N. Hanson and Charles R. Wilke, entitled "Electrostatic Precipitation Apparatus and Process" which is a continuation-in-part of now abandoned application Ser. No. 518,405 filed Jan. 3, 1966 in the names of Donald N. Hanson and Charles R. Wilke, entitled "Electrostatic Precipitation Apparatus and Process."

BACKGROUND OF THE INVENTION

The present invention is directed to an electrostatic precipitation apparatus and process, and more particularly to an apparatus and process where additional particles are added to a stream carrying foreign undesirable particles, e.g. dust particles, to enhance precipitation.

Electrostatic precipitation as a method of cleaning dust laden air is now accomplished by the following two steps:

1. Dust particles are given an electrostatic charge; and

2. The charged particles are then conveyed through an imposed electric field which causes the particles to drift to a collector such as a wall, screen, filter or the like which is periodically cleaned.

Although the efficiency of collection of such precipitators may be quite high, such precipitators, to reach a satisfactory efficiency, are relatively large and expensive. Another disadvantage of present precipitators is the requirement for high voltages, and thus, high voltage equipment in the collecting section. This type of equipment is expensive and also has a degree of danger.

SUMMARY OF THE INVENTION AND OBJECTS

Accordingly, it is a general object of the invention to provide an improved electrostatic precipitating apparatus and process.

It is another object of the invention to provide a highly efficient electrostatic precipitating apparatus and process which is relatively inexpensive.

It is yet another object of the invention to provide an electrostatic precipitating apparatus and process which requires no high voltage equipment in the collecting stage of the precipitation process. It is still another object of the invention to provide an electrostatic precipitating apparatus and process in which the precipitation of foreign particles in the gas stream is accomplished by the mutual electrostatic repulsion of the charged particles present in the gas stream.

In accordance with the above objects there is provided an electrostatic precipitator for removing foreign particles from a gas stream comprising means for introducing into the gas stream additional particles. Electrostatic charging means charge both the foreign particles and the additional particles with a charge of predetermined polarity. Conductive surface means are coupled to ground, at least partially bound the gas stream, and are located down stream of at least a portion of the charging means. The charged particles thereby serve to provide a space charge region adjacent to the conductive means where at least a portion of the foreign particles and additional particles move under the influence of the electric field toward the conductive surfaces to be deposited thereon.

BRIEF DESCRIPTION OF THE DRAWINGS

FIG. 1 is a simplified elevation view, partially in section, showing a portion of the precipitation apparatus in accordance with the present invention;

FIG. 2 is a cross-sectional view taken along line 2—2 of FIG. 1;

FIG. 3 is a perspective view of one of the collector tubes of FIG. 1 and 2;

FIG. 7 is a cross-sectional view similar to FIG. 2 but showing a modification of the charging apparatus;

FIG. 8 is a cross-sectional view showing another embodiment of the invention;

DETAILED DESCRIPTION OF THE PREFERRED EMBODIMENTS

Figure 4:
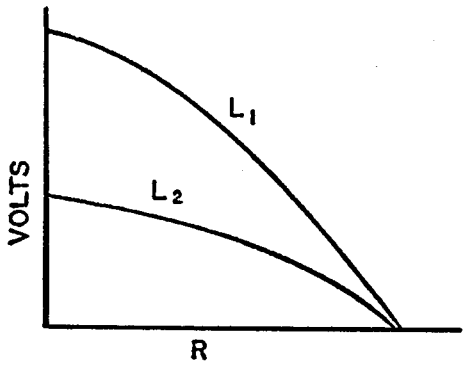
FIGS. 4, 5 and 6 are graphs useful in understanding the inventive apparatus and process.

In FIG. 1, there is illustrated a two-stage precipitation apparatus. The inlet for the contaminated or dust laden air is indicated at the left-hand side of the apparatus and the outlet is indicated on the right-hand side of the apparatus. As will be described in greater detail below, the first stage 10 of the precipitator cleans the incoming gas stream of a large fraction of its foreign particles and the second stage 20 removes a large fraction of the remaining impurities to provide a highly pure or clean air output.

Each stage 10, 20 is divided into a charging section and a collector section. The charging sections include conductive leads 12 and 22 which extend through the wall of the apparatus and are insulated therefrom by insulators 13 and 23. The leads are connected to a source of negative uni-directional voltage, -V. Conductive probes 14 and 24 are electrically connected to the conductive leads and extend into the adjacent collector sections.

The collector sections include a number of longitudinal passageways 16 and 26 formed with conductive walls. The passageways may, for example, be formed by conductive cylindrical tubes as shown in FIG. 2. The tubes are closely packed and connected to a common voltage point, ground, as shown in the FIGS. Alternatively, a larger single tube may be used with satisfactory results. The passageways may be formed with tubes having different cross-sections; for example, square, hexagonal, etc. It will become apparent that the size and shape of the tubes is not the critical feature of the invention.

Additional or supplementary particles, such as water droplets, are introduced into the gas stream through spray nozzles 17 and 27 before the gas stream enters the charging sections. As will be described more fully below, liquid or water droplets are precipitated along with the incoming foreign particles onto the surfaces or walls of tubes 16 and 26, coalesce, entrapping the solid particles, and flow by gravity or other means along the walls of the tubes to collecting troughs 18 and 28 which are located at the upstream ends of units 10 and 20.

Incoming foreign particles (dust and other contaminants) and the introduced additional or supplementary particles in the airstream are electrostatically charged by passing them through a suitable electric discharge. In the apparatus illustrated, the electric discharge is generated by applying a voltage between the probes 14 and 24 and the tubes 16 and 26 into which the probes extend. Each fine wire electrode is coupled to the negative polarity voltage source, $-V$, and with a suitable voltage difference, an electric discharge provides for the electrostatic charging of any particles passing therethrough. The charging arrangement of FIG. 2, in which charging takes place predominantly inside the tubes, allows creation of high space charge within each tube while reducing the possibility of voltage breakdown since the relatively small tube diameter limits the field created by the space charge. The additional particles from nozzles 17 and 27, are of course, also charged with the same electrostatic polarity as the foreign particles when they pass through the charging sections.

FIG. 3 illustrates in greater detail a representative tube 16 of the collector section of the first stage, 10. The direction along the center line of the tube is indicated as "L," and the radial direction as "R."

When the foregoing combination of particles pass through the charging section, they are electrostatically negatively (or alternatively, positively) charged to provide a space charge region within the tubes 16 and 26. Such space charge region is graphically illustrated in FIG. 4 which shows the potential as a function of "R" at two longitudinal points $L_1$ and $L_2$. The electric field intensity, the slope of the curves, starts at zero at the center line and reaches a maximum at the wall of the tube. Two curves are illustrated, the $L_1$ curve being taken near the entrance to the tubes 16 or 26, and the $L_2$ curve downstream of the entrance. The maximum amount of electric field intensity, encountered at the upstream ends of the tubes, is determined by the concentration of the contaminants and added particles, and by the amount of charge on each particle. The charge on an individual particle is determined principally by the field in the charging section and by the surface area of the particles. Thus, to reach a selected maximum electric field strength, it is necessary to adjust the particle concentration by the addition of a sufficient amount of additional particles of suitable size, such as water droplets, from the inlet nozzles 17 and 27. The particles are subjected to the electric field created by the space charge in the tubes. The electric field gives rise to a force which causes the particles to migrate toward the walls where they are collected.

This may be more clearly understood if one considers that the mutual repulsion between the particles causes a large percentage of them to be deposited on the walls of the tubes. The rate of deposition or efficiency of this repulsion effect is, as mentioned above, proportional to the total electric field strength which, in turn, is determined by particle concentration and charge on the individual particles. The liquid particles, for example, water, which are collected, flow down the walls of the tubes and are collected in the troughs 18 and 28. Of course, as the water flows down the walls of the tubes, it carries away the contaminant particles.

Figure 5:
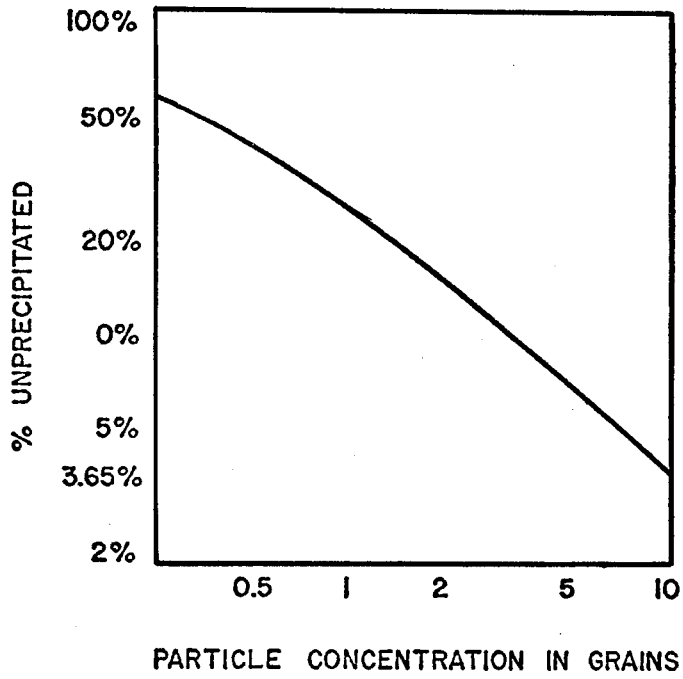

FIG. 5 shows the effect of the initial particle concentration as expressed in grains per cubic foot of the per cent of particles unprecipitated in a typical example. Both axes are logarithmic and the parameters such as charge and particle diameter are given in the example, infra. From the curve, it is apparent that efficiency falls off rapidly with lower initial particle concentrations.

Figure 6:
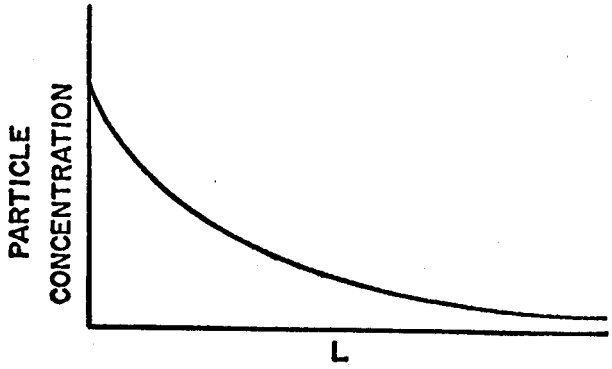

The curves of FIGS. 4, 5 and 6 were derived from simultaneous solution of Poisson's equation and the equation of particle continuity for a cylindrical tube through which a particle-laden gas was flowing in laminar flow. Under turbulent flow precipitation is even more efficient. Solution of the equation requires finite-difference techniques for the solution of the two coupled partial differential equations. This is readily accomplished by means of a computer.

The reduction of particle concentration as a function of the distance "L" along the tube is illustrated in FIG. 6. The slope of the curve represents the rate of precipitation. It is seen that the rate of precipitation is very rapid near the entrance to the tube and levels off to a low value near the downstream end of the tube. This is, of course, due to the much higher electric fields at the entrance to the tube. Thus, most of the precipitation of particles (contaminant and added) occurs at the initial upstream portion of the tube and relatively little more is accomplished toward the downstream end. This behavior logically follows since, as the initial particles precipitate out and deposit on the walls of the tube or the surfaces, the amount of space charge is reduced. Since this space charge in turn determines the rate of precipitation, as the particles precipitate the driving force for precipitation vanishes and the rate falls off toward zero. FIG. 6 also shows that the portion of the tube nearer the entrance is the most effective portion. A single stage with long tubes is thus less effective than two or more stages with shorter tubes.

Particle size is also a factor in the efficiency of precipitation but is not critical to the application of the invention. The velocity of any individual particle moving toward the wall surface of any one tube is affected by the charge on the particle, which is determined principally by its surface area and by its mobility. The mobility is inversely proportional to drag which is related to the diameter of the particle. However, since charge is proportional to surface area or diameter squared, the larger size particles are readily precipitated since the increased amount of charge more than compensates for the increased drag. For smaller particles with a reduced amount of electrostatic charge on them, the drag is not reduced a sufficient amount to compensate for their reduced charge. However, the charge is still large enough to maintain reasonable precipitation efficiency, and as particle size is further reduced, below approximately one micron, the ratio of charge to drag again becomes more favorable for precipitation. Highly successful precipitation is thus feasible over the complete range of particle sizes.

Other factors may be important in determining the desired particle size of the introduced additional particles. For example, where water droplets are introduced, if the water droplets are too small, they may be unnecessarily difficult to collect. Conversely, if the water droplets are too large, they may tend to precipitate out against the tube walls more quickly than the smaller dust particles. Under the latter circumstances, precipitation efficiency is reduced since the rapid precipitation of the water droplets causes an attendant reduction in electric field intensity which, in turn, causes a reduction in the precipitation rate of the undesirable particles.

With the use of water droplets, in addition to providing a sufficient electric field to cause rapid precipitation, the water also traps and washes the dust particles deposited on the walls of the tubes, preventing re-entrainment. Since the airstream moves through the collector sections 16 and 26 with a certain velocity, there is a tendency for the deposited material to be dislodged and dragged along the surface by the action of such airstream. The liquid film provides for trapping deposited material and for a rapid run-off of the collected dust particles to collecting troughs 18 and 28. Furthermore, the conductive quality of water prevents any charge buildup of the particles against the wall which would provide a reduction in electric field intensity at this point. The major factor in the prevention of charge buildup on the walls of the collector tubes is the coupling of them to ground which functions as an electron sink to discharge deposited negatively charged particles.

The output of the first stage 10 of the precipitator has both a combination of additional particles, water droplets added by nozzle 17, and contaminant particles which were initially in the impure incoming air. For illustration, consider the case where the contaminant particles and the added water droplets are the same size and shape. These two types of particles exist in a proportion which is equal to the original proportion of water droplets introduced at the upstream end of the unit compared to the initial contaminant particle concentration. Thus, for example, if an equal number of water droplets were added to the existing foreign particles, the same ratio would exist at the output end of the first unit. If the collection efficiency or precipitation efficiency was 96 percent, meaning that only 4 percent of all the particles remained uncollected, then 2 percent of these would be water droplets and 2 percent foreign or dust particles.

Where the remaining foreign particles are of such an amount to be tolerable for the specific environment in which the precipitator is used, a single stage or unit of precipitation may provide sufficient cleaning. In situations, however, where the foreign particles are particularly noxious, and even very small amounts are undesirable, a few additional stages of precipitation will provide for almost total elimination of such particles. This is provided, for example, by stage 20 and, as explained above, the amount of remaining foreign particles in the output of stage 20 is determined by the initial ratio of water droplets and foreign particles at the entrance to the stage. Thus, assuming another 96 percent precipitation efficiency of stage 20 through the addition of sufficient water droplets to bring up the particle concentration to the same amount as that entering the first stage 10, the amount of contaminant particles precipitated in the two stages will be 99.84 percent of the initial foreign particles.

Even higher collection efficiencies may be achieved by the addition of further stages. But, it is apparent that the process provides efficiencies of such magnitude that several stages would be necessary only in rare situtions. The collecting zones 16 and 26 need not be electrically isolated, nor is there any danger of high potentials since all electrostatic charging of both the water and dust particles occurs in the vicinity of charging probes 14 and 24 which are separate from the collecting tubes.

Depending on the specific application of the precipitator, the additional particles added, which in the preferred embodiment were water droplets, may be other liquid substances which serve as a wetting agent, such as oil for carbon particles, or alternatively even solid particles. In the latter case, the solid particles would provide the proper repulsive space charge field. Any re-entrainment of deposited particles on the tube walls could be prevented by a liquid sheet continually rinsing the tube walls.

In the above mentioned case where, for example, oil is used as a wetting agent for a carbon foreign particle, and it is undesirable for any noxious oil droplets to remain in the output of the precipitator, a second stage of precipitation may be used in which water droplets, which are innocuous when discharged into the atmosphere, are mixed with the oil droplets remaining from the first stage of precipitation to reduce the amount of oil droplets in the output gas stream from the second stage. This system could also be used where additional solid particles are initially introduced in the first stage of precipitation.

The following example illustrates the performance of a single tube in apparatus of the type shown in FIG. 1.

| | |
|---|---|
| Tube Length | – 3 feet |
| Tube Diameter | – 1 inch |
| Average Air Velocity | – 3 ft. per second |
| Inlet Particle Concentration (including both water droplets) and dust) | $4.4 \times 10^7$ particles per cubic centimeter |
| Particle Diameter (Both dust and spray) | – 1 micron |

In the above example, a charge of 261 electronic charges per particle was used.

The fraction of particles that are precipitated in the first stage of precipitation is 96.35 percent. With the use of the second stage of precipitation and the addition by nozzle 27 of sufficient supplementary water droplets to again build a particle concentration equal to the initial particle concentration, the total precipitation efficiency achieved is 99.87 percent of the original dust particles.

The electrostatic charging means illustrated in FIGS. 2 and 3 with electrodes 14 or 24 located in close proximity to the opening of each tube may be modified as desired. For example, as illustrated FIG. 7, there may be a single corona wire for a group of several tubes. Here, there are provided vertical corona wires 30 and 31 which, in combination with grounded cylindrical rods **32*a*, 32*b* and 32*c***, provide an electrostatic charging field.

In another method of charging the added water droplets, they may be sprayed from a nozzle (see FIG. 8) which is held at a suitable negative potential with respect to ground. Such charged sprays may be used to entirely eliminate normal corona charging in stages past the first stage. Alternatively, individual nozzles might be associated with each collecting tube.

Charging of the dust particles may also be accomplished by partial evaporation of charged water droplets. As the droplets are reduced in size, charge will escape from them which will collide with and charge the surrounding dust particles. Such a method of charging of the dust particles can be used most effectively in streams of high temperature where evaporation of charged sprays will cool the gas stream and at the same time charges the foreign particles. A device such as shown in FIG. 8 may be used for this dual charging.

In some cases, the initial dust concentration of foreign particles may be sufficient in itself to provide an electric field intensity for successful precipitation of a large portion of the particles in the first stage 10. Where this is possible, water droplets may be added only by the nozzle 27 at the beginning of the stage 20 to again provide sufficient concentration of particles and electric field intensity to precipitate out almost all of the remaining dust or foreign particles.

Figure 9:
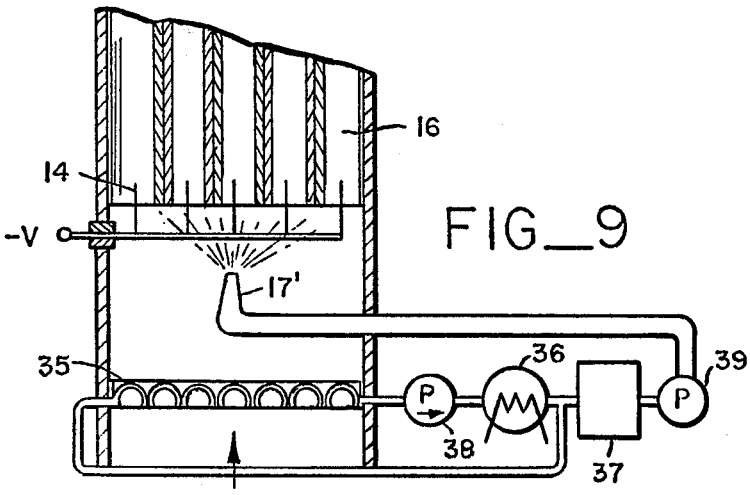
FIG. 9 is a cross-sectional view of still another embodiment of the invention.

FIG. 9 shows an alternative embodiment of a precipitator which may be vertically oriented and placed directly in a chimney to collect combustion products. Collector tubes 16 are vertical as is the nozzle 17'. The runoff of water droplets from the tube walls is collected by a tray 35 which allows for passage of the impure incoming air but captures the water droplets.

Such arrangement can be used with a non-volatile liquid to effect particle removal and substantial heat recovery from a hot gas stream in one unit. The sprayed liquid becomes hot and is circulated through a heat exchanger 36 before being purified by filtration means 37, and returned to the spray nozzle. In general, only a portion of liquid would be sprayed. Circulation of the main liquid is provided by pump 38, through heat exchanger 36 and back to the tray 35. The remainder of liquid would be pumped through filter 37 by pump 39 to the spray nozzle 17'. Droplets of the non-volatile liquid remaining in the gas could be removed in a second stage in which water sprays were used.

In order to achieve a maximum degree of precipitation with minimum residence time in the precipitating section it is desirable to establish a high concentration of space charge. However, as illustrated in FIG. 6, as the gas flows down the length of the precipitator the charge level drops. Also, as in the previous embodiment, as for example, FIG. 1, it has been shown how greater precipitation efficiency can be achieved by providing succeeding stages to, in effect, rebuild the charge concentration.

Figure 10:
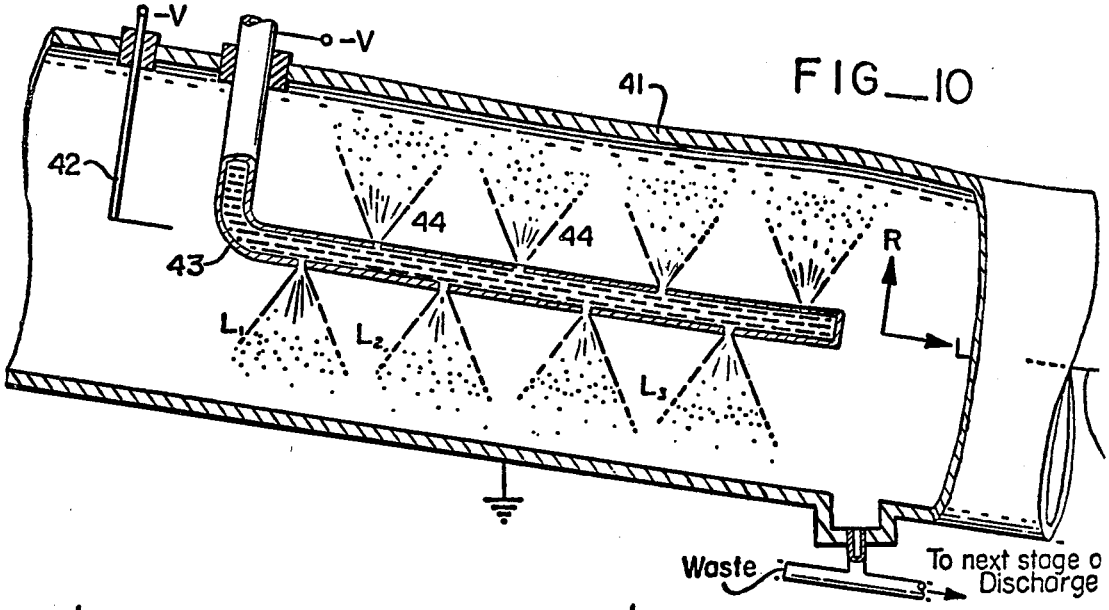
FIG. 10 is a cross-sectional view of yet another embodiment of the invention.
Figure 11:
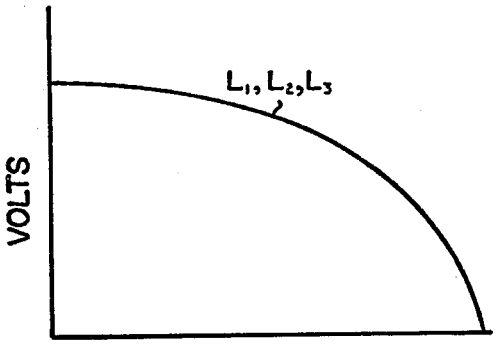
FIGS. 11 and 12 are graphs useful in understanding the embodiment of FIG. 10.

In accordance with the invention, the embodiment of FIG. 10 provides, in essence, a level of space charge which is the same along the length of the precipitating section. This is achieved by the continuous addition of supplementary charged particles such as water along the collection section of the precipitator. Thus, this yields the characteristic as shown in FIG. 11 of the electric field in the precipitating section where $L_1$, $L_2$ and $L_3$ represent successively longer distances down the precipitator section. More specifically, these are shown in FIG. 10 along precipitator section 41.

FIG. 10 illustrates a simplified single tube precipitator with a corona charging electrode 42 coupled to a negative voltage source and with the collector 41 grounded. Additional particles are introduced through a central tube 43 containing a plurality of spray nozzles 44. Central tube 43 is again coupled to a source of negative potential. By introducing additional particles in several locations in a region of the conductive collector 41, space charge levels at locations $L_1$, $L_2$, and $L_3$ are maintained substantially constant. Moreover, in view of this method of buildup of space charge only a single large collector tube section 41 may be used in the proximity of the corona rod 42 since the space charge level can instead be built-up by the continuous insertion of additional particles. As was mentioned above, higher initial space charge levels are produced by use of smaller tubes with individual corona wires as shown in FIGS. 1 and 2.

Figure 12:
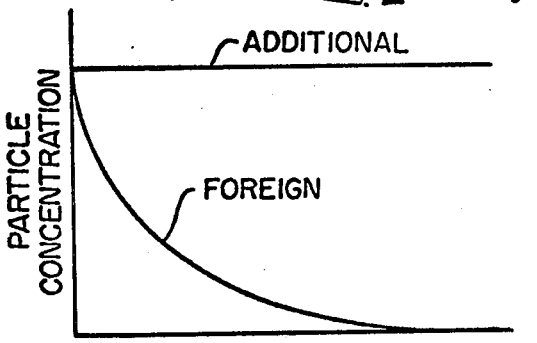

FIG. 12 shows how the particle concentration of the additional charged water particles is maintained constant over the collecting length of the collecting section 41 because of the continuous addition of these particles. Since these charged water droplets tend to maintain a maximum space charge level throughout collecting section 41, the foreign particles are naturally almost entirely precipitated out. Thus, by the use of the continuous addition of supplementary particles a single stage precipitator of this type will be feasible for many applications.

Figure 13:
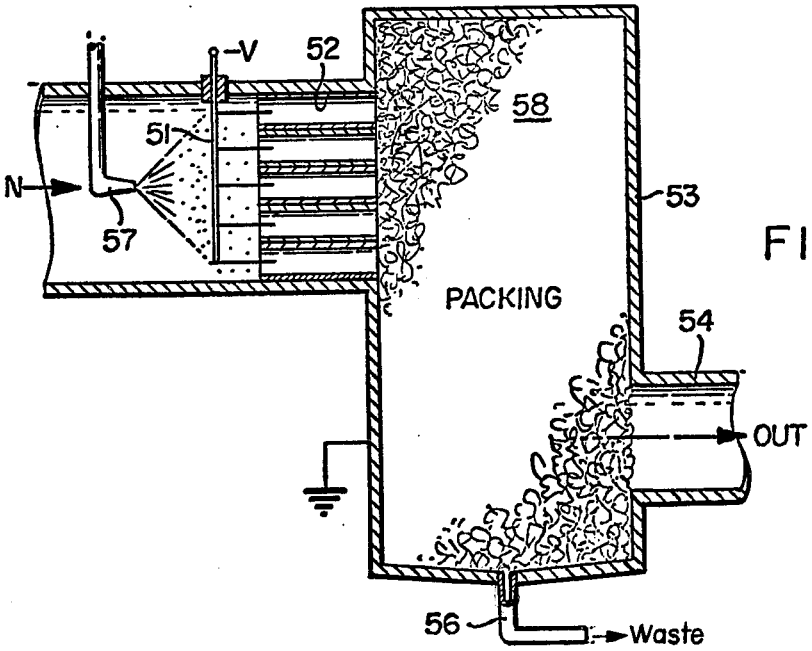
FIG. 13 is a cross-sectional view of another embodiment of the invention.

Still another embodiment is shown in FIG. 13 where in the inlet section of the precipitator corona wires 51 extend into grounded tubes 52 which are coupled into a chamber 53 having a conductive packing material 58 of predetermined size and type. An outlet port 54 is provided for the gas stream and at 56 the waste material or foreign particles in the liquid are collected and drained off. A nozzle 57 provides additional water particles.

In operation, the conductive packing material serves the same function as the conductive tube walls in the other embodiments of the invention the particles being precipitated out on the packing material and drained by gravity toward drain port 56.

Since the concentration of space charge in a given apparatus is limited to that level high enough to cause electrical breakdown of the gas, the smaller the tube diameter the greater the allowable amount of space charge. However, the construction of a precipitator containing very small diameter tubes presents mechanical difficulties in tube layout and is generally more expensive per unit volume than a unit with large diameter tubes. With the use of a packing material indicated at 58, the packing material, in effect, offers small channels for gas flow and provides a large amount of surface area per unit volume. Tubes 52, which may be a very short section of small diameter tubes increase the space charge to a maximum. Precipitation occurs on the packing material and the vessel walls which are irrigated by precipitated water particles. The gas passes through the packing and loses its space charge to a level which will permit it to be passed through the outlet duct 54 to be either discharged to the atmosphere or to another stage of precipitation.

In actual practice, the packing may be wire mesh having an effective electrical diameter equal to or less than the diameter of one of the tubes 52. If the effective electrical diameter of the mesh is larger than the tube diameter and the initial space charge level of the gas stream is at a maximum then electrical breakdown would occur. On the other hand, the interstices of the packing should be large enough to promote the easy flow of gases. Thus, in practical applications, the average effective electrical diameter is the distance between two wires of, for example, a wire mesh type packing which is substantially the same as the diameter of the charging tubes 52.

Again, with the embodiment of FIG. 13, the precipitation efficiency is significantly improved because of the higher concentration of space charge without the difficulty of small diameter tubes.

In conclusion, the present invention provides an improved electrostatic precipitation apparatus and process which is highly efficient and relatively low in cost. Electrical isolation problems are reduced since the collecting units have no high potential electrodes. It provides for easy collection of the dust particles since the water droplets or other liquid utilized for the precipitation also serve the purpose of entrainment of these particles and their subsequent removal by liquid runoff into the receiving trough. The simple shape of the precipitator provides for easy glas flow through it and thus enables it to be located directly in the ducting or smoke stack of a contaminant producing source with very minor modifications. Moreover, the fact that one or two, or at most a few, stages provide for highly efficient precipitation means that only a very small space is required.

The apparatus of the present invention can be used for removing many types of particulate impurities from gas streams. The invention may be particularly useful for sterilization of air by essentially complete precipitation of microorganisms through employment of a multistage process.

We claim:

1. An electrostatic precipitation process for continuously removing foreign particles from a gas stream and depositing said particles on conductive surface means coupled to ground and at least partially bounding said gas stream including the steps of introducing into said gas stream in the vicinity of said surface means a predetermined number of additional particles and electrostatically charging both said foreign particles and said additional particles with a charge of the same predetermined polarity, such predetermined number of additional particles being selected that together with said foreign particles there is provided adjacent said surface means a space charge region of sufficient intensity where substantially all of said foreign particles and said additional particles move towards said surface means and are deposited thereon under the influence of the electric field formed by said space charge region.

2. The process as in claim 1 wherein said additional particles are water droplets.

* * * * *